United States Patent [19]

Vetter

[11] 4,405,086

[45] Sep. 20, 1983

[54] DEVICE FOR ATOMIZING LIQUID COLOR

[75] Inventor: Kurt Vetter, Remseck, Fed. Rep. of Germany

[73] Assignee: Hans Behr, Stuttgart, Fed. Rep. of Germany

[21] Appl. No.: 220,586

[22] Filed: Dec. 29, 1980

[30] Foreign Application Priority Data

Jan. 15, 1980 [DE] Fed. Rep. of Germany ..... 3001209

[51] Int. Cl.[3] ..... B05B 3/10

[52] U.S. Cl. ..... 239/224

[58] Field of Search ..... 239/223, 224, 700, 701

[56] References Cited

U.S. PATENT DOCUMENTS

| | | | |
|---|---|---|---|
| 3,017,116 | 7/1962 | Norris | 239/224 X |
| 3,233,580 | 2/1966 | Levake | 239/223 X |
| 3,504,851 | 4/1970 | Demeter | 239/224 X |
| 4,214,708 | 7/1980 | Lacchia | 239/224 X |
| 4,303,200 | 12/1981 | Hansen | 239/223 |

*Primary Examiner*—John J. Love
*Assistant Examiner*—Gene A. Church
*Attorney, Agent, or Firm*—Martin A. Farber

[57] ABSTRACT

In an atomizer wheel for the atomization of liquid color, particularly a lacquer sprayer, having an atomizer bell which is rotatable around a central axis and on its axially front end side has an annular coaxial overflow surface and on its base a central axial opening and is provided above its base with a deflection part of rotational symmetry.

9 Claims, 2 Drawing Figures

DEVICE FOR ATOMIZING LIQUID COLOR

The present invention relates to a device for atomizing liquid color, particularly a lacquer sprayer, having an atomizer bell which is rotatable around a central axis and on its axially front end side has an annular coaxial overflow surface and on its base a central axial opening and is provided above its base with a deflection part of rotational symmetry the rear side of the center of which is opposite the opening while its radially outer edge is adjacent the overflow surface, the intermediate space between the deflection part and the base being connected with the free bell space above the overflow surface in a liquid-conducting manner; and having a nozzle which is seated on the free end of a coaxial color feed tube, which nozzle extends into the said space and discharges opposite the center of the deflection part.

In one known device of this type, the atomizer bell thereof is provided with a deflection part which has the shape substantially of a circular disk and which on its front side has a concave, slightly conical end surface and on its rear side a conical hub which is located spaced from the nozzle opening. The edge of the deflection part extends freely beyond an annular attachment part connected with it to in front of the radially inner edge of the overflow surface from which it maintains a certain distance, which distance, however, is less than the axial length of the concave overflow surface so that the entire deflection part lies within the bell. The elastic attachment part which is clamped by the radially inner circumference of the bell has a plurality of small radial channels distributed uniformly on its circumference which channels are adjacent the rear side of the edge of the deflection part and discharge tangentially onto the inner edge of the overflow surface. The color therefore flows axially out of the nozzle into the intermediate space between deflection part and base of the bell which is surrounded by the fastening part, in which space the stream of color is deflected radially by the hub of the deflection part, whereupon the centrifugal action of the deflection part which rotates with the bell commences on the deflected stream of color and sees to it that the color flows on the rear of the deflection part to the edge of the latter where it passes through the channels onto the overflow surface of the bell.

The deflection part of the known device has the disadvantage that particles (even, in case of electrostatic operation of the device, discharged particles) of color which have been atomized to a mist pass by suction onto the front side of the deflection part where they are not thrown off if the color contains, as in the case of lacquers, a readily volatile solvent which vaporizes or evaporates after the color has been formed into a mist and allows the color to adhere to the front side of the deflection part. Even in the case of aqueous colors droplets of mist deposit on the front side of the deflection part and are not thrown off because of the drying-on which takes place as a result of the evaporation of water. These color particles which remain seated on the front part of the deflection part must be removed before a change in color, for which purpose, in the known device, there is employed a capillary tube of a rinsing device from which tube an organic or aqueous solvent is sprayed onto the front side of the deflection part before the device is charged with the new color. This however requires a particular expenditure of time upon change in color, aside from the sensitive capillary tube.

Upon the spraying of metallic lacquers, which in addition to color pigments and solvents contain metal particles and binders, agglomerates of metal particles form on the front side of the deflection part of the known device and adhere there as a result of the particularly high volatility of the solvent and the effectiveness of the binder. These agglomerates are now and again detached here and there and thrown off centrifugally against the overflow surface where they pass into the color stream and finally onto the object to be sprayed with color, where they form disturbing defects in the lacquer.

The object of the present invention is now to avoid the disadvantages described above and to provide a device of the aforementioned type which reduces the expense necessary for the change in color and prevents the formation of injurious agglomerates of metal particles.

This object is achieved in accordance with the invention in the manner that the deflection part is provided in its center with a cannulae labyrinth with a radial component, which labyrinth has a coaxial inlet lying opposite the nozzle opening and a coaxial outlet onto the front side of the deflection part; and that the front side of the deflection part forms an annular coaxial overflow surface for overflow by a partial stream of the color which at the edge of said surface discharges into the main stream of color flowing on the end-side overflow surface of the bell. In this way the result is advantageously obtained that droplets of mist which have deposited on the front side of the deflection part are taken up by the partial stream of color flowing there and thereby dissolved so that they do not remain there and that metal particles which have deposited on the overflow surface of the deflection part experience the same fate so that they cannot agglomerate. Solvent which is subsequently passed through upon a change in color washes away the wet color film which still adheres after the end of the spraying.

In one preferred embodiment of the device of the invention the radially outer edge of the overflow surface of the deflection part and the radially inner edge of the overflow surface of the bell are flush. The partial stream of the color can therefore flow smoothly into the mainstream.

The preferred embodiment is a device whose atomizer bell, as in the known device, is provided with an attachment part, developed in one piece on the radially outer edge of the deflection part, for fastening the deflection part to the radially inner circumference of the bell, substantially radial small channels extending from the intermediate space being formed at the transition from the deflection to the attachment part. In the preferred embodiment, furthermore, an annular hollow space is developed at the transition from the deflection part to the attachment part, into which space the channels discharge and which debouches into the free bell space via an annular slot between bell and deflection part at the place of encounter of the adjacent edges of the overflow surfaces of the bell and of the deflection part. In this way there is assured a charging of the end-side overflow surface of the bell which is more uniform over the circumference of the bell, so that a correspondingly improved application of color is obtained.

In the preferred embodiment, the hollow space consists of an annular groove in the attachment part, closed by the bell, which groove is easy to produce and is readily accessible for cleaning.

The preferred embodiment is a device whose deflection part, as in the case of the known device, is essentially a circular disk with central hub which protrudes towards the nozzle. In the preferred embodiment, the hub contains the cannulae labyrinth which is arranged at a suitable place there, where it finds sufficient room.

In the preferred embodiment, the deflection part is provided on its front side with a stepped substantially cylindrical depression with inner shoulder on which there rests an insert ring whose central bore, rounded in front, forms the outlet of the cannular labyrinth and which terminates at the front flush with the overflow surface of the deflection part.

The insert ring can be made of very accurate shape and then inserted into the deflection part.

In the preferred embodiment, the inlet of the cannulae labyrinth in the hub is developed as a coaxial bore which is connected via a plurality of uniformly distributed tap cannulae with the annular space at the base of the depression behind the insert ring. This shape of labyrinth is simple to produce and assures an axially slow partial flow onto the overflow surface of the deflection part.

In the preferred embodiment the cannulae labyrinth, including inlet and outlet, is so developed that the partial stream of color is adjustable to less than one-half of the total stream through the nozzle.

The invention will be explained below with reference to the preferred embodiment of the device of the invention which is shown by way of example in the drawing, in which.

Figure 1:
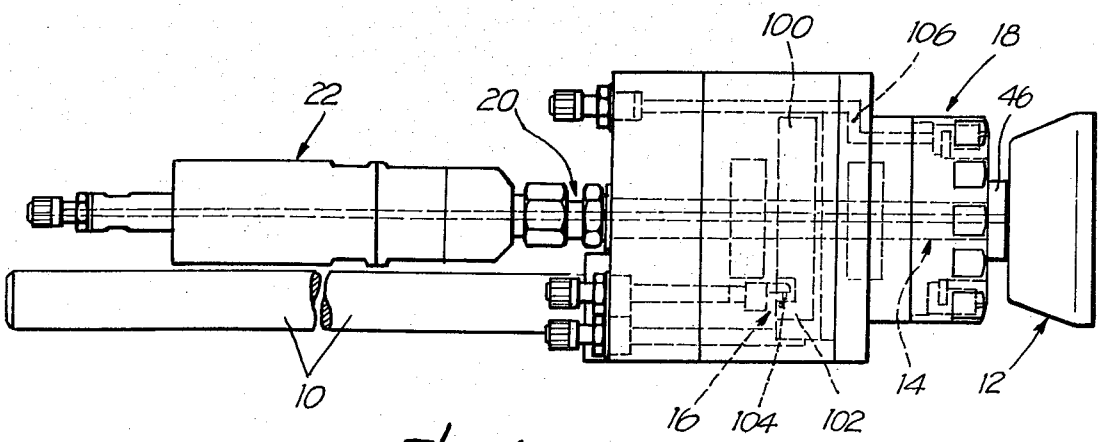
FIG. 1 is a side view of the embodiment on a reduced scale.
Figure 2:
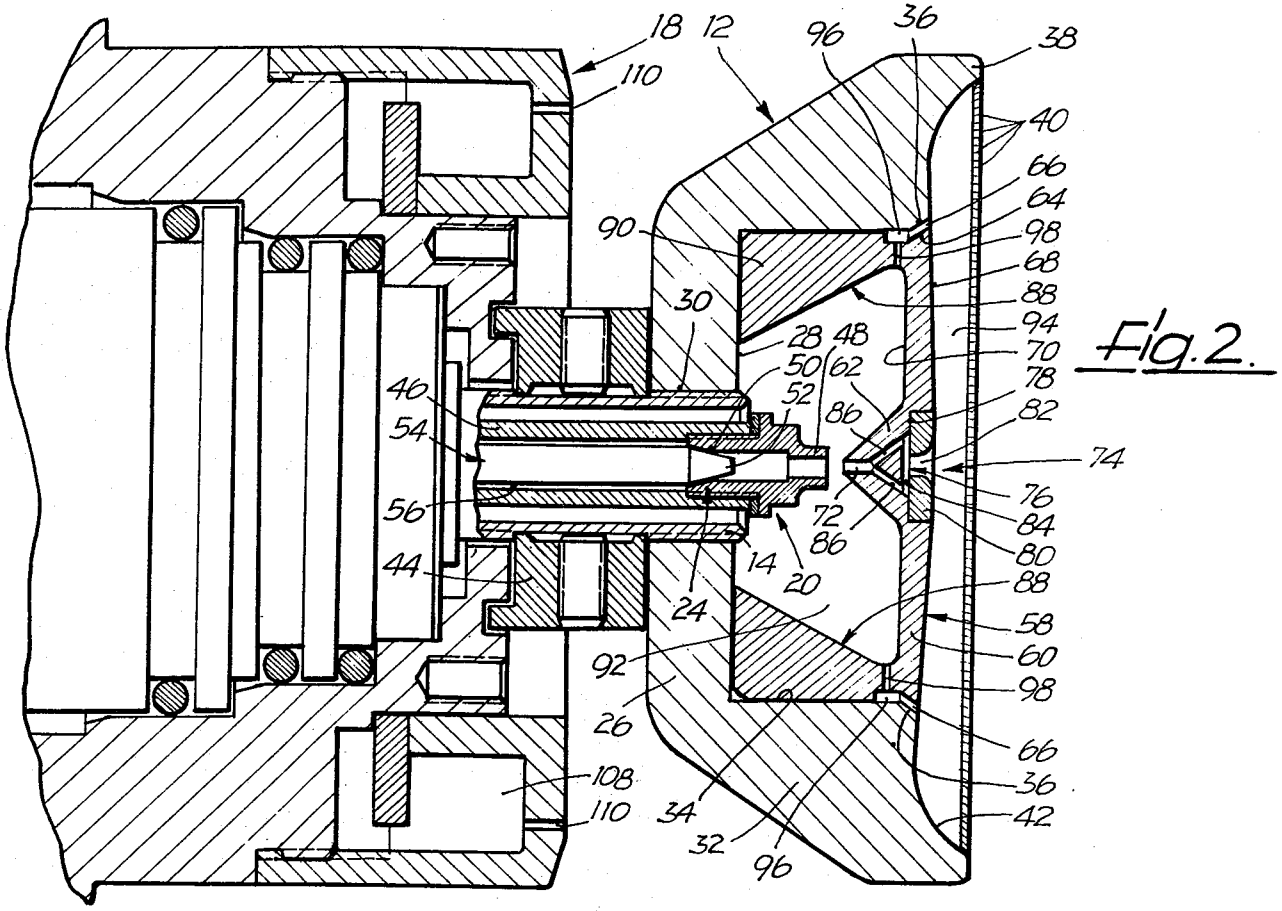
FIG. 2 is a fragmentary central-axial longitudinal section through the embodiment.

The embodiment of the device of the invention, which can be attached by means of a bar 10 to a frame, consists primarily of a rotating atomizer bell 12, of a hollow shaft 14 the front end of which bears the bell fixed for rotation with it of a pneumatically operated motor 16 for the driving of the shaft, of a blow device 18, of a color feed device 20, and of a pneumatic cylinder-piston unit 22 for actuating a valve 24 of the color feed device.

The single-piece atomizer bell 12 made, for instance of aluminum on a lathe, consists in its turn of a bottom 26 having the shape of a circular disk and forming its base 28, provided with an internally threaded bore 30 as central opening; of a ring 32 which is developed extending forward on the edge of the bottom 26 and has a circular-cylindrical opening 34 which terminates at the base 28, located in a radial plane, and has a forward-diverging conical bevel 36 on its axially front edge; of an annular lip 38 formed on the ring 32 and protruding axially forward, the edge of which lip has a large number of small inner grooves 40 distributed uniformly on the circumference; and of an annular overflow surface 42 which commences at the bevel 36 and terminates at the grooves 40 and is thus located at the end, the profile of said surface being composed approximately one-half each of a straight line commencing at the bevel 36 and of a circular arc terminating at the grooves 40. The straight-profile section results in an inner annular surface which converges extremely slightly axially towards the rear and the arc-profile section results in a tangentially attached annular surface which diverges decreasingly axially towards the front, they supplementing each other to form the overflow surface 42.

The atomizer bell 12 is screwed by its threaded bore 30 onto the front end of the hollow shaft 14, which has an external thread and is tightened against a stop ring 44 to assure full rotation with the base 26 of the bell, the said stop ring being fixed axially on an unthreaded portion of the hollow shaft 14. A coaxial color feed tube 46 of the color feed device 20 extends, without contact, within the hollow shaft 14, which device also includes a nozzle 48 which is partially screwed, with seal, into the color feed tube 46 which ends at the base 28 of the bell 12 and, within the end of the tube, forms a conical valve seat 50 for the valve 24 of the device 20, the body of which valve is the frustoconical tip 52 of a valve-actuating needle 54 which lies, with radial play on all sides, in the color feed tube 46 and forms with it an annular color feed channel 56.

The atomizer bell 12 is provided with a deflection part 58 which deflects into all radial directions the stream of color emerging axially from the nozzle 48 and divides it into a main stream which flows on its rear side and a partial stream which flows on its front side and which should amount to about one-quarter of the total stream. This deflection part 58 comprises essentially a flat circular disk 60 with a central hub 62. The circular disk 60 is provided on its outer edge with an axially forwardly diverging cone-shaped circumferential surface 64 whose cone angle corresponds with the cone angle of the bevel 36 so that it forms an annular slot 66 of constant width with the circumferential surface 64. The front side of the circular disk 60 represents an overflow surface 68 of the deflection part 58, said surface converging extremely slightly axially towards the rear and passing at the annular slot 66 within the plane of the opening thereof, without step or bend, into the overflow surface 42 of the bell 12.

The rear side of the deflection part 58 which receives the main flow of the color is formed of the hub 62 which is conical outside of the circular disk 60 within which it is substantially cylindrical and of a surface 70 of the circular disk 60 which surface lies primarily in a radial plane outside the hub. The axially rearwardly pointing tip of the hub 62 is located spaced in front of the mouth of the nozzle 48, into the free cross section of which it extends. An axial bore 72 of the hub 62 which commences at its tip is the inlet of a cannulae labyrinth 74 of the deflection part 58 which on its front side has a coaxial depression 76 with an inner shoulder 78 on which there rests an insert ring 80 which is adapted to the depression 76 and has a bore 82 which is rounded at its front edge and forms the axial outlet of the cannulae labyrinth 74. The insert ring 80, whose front side passes at its edge smoothly into the overflow surface 68 of the deflection part 58, forms, with the base of the depression 76, an annular space 84 of the cannulae labyrinth 74, which includes also axially forwardly diverging straight tap cannulae 86 which discharge on one side into the hub bore 72 and on the other side into the annular space 84.

At the edge of the deflection part 58 there is integrally developed an attachment part 88 which has an elastic holding ring 90 of trapezoidal cross section surrounded on one side axially by the opening 34 and radially by the base 28 of the atomizer bell 12, respectively, said holding ring surrounding the intermediate space 92 between the circular disk 60 of the deflection part 58 and the base 28 of the bell 12. Adjoining the annular slot 66 which discharges into the free bell space 94 there is formed, by an annular groove 96 in the attachment part 88, a hollow space which is closed by the ring 32 of the bell 12 and is in communication with the intermediate space 92 via a large number of radial cannulae 98 distributed uniformly over the circumference of the circular disk 60 and arranged at the transition from the attachment part 88 to the deflection part 58 at the rear surface 70 of the latter.

The pneumatic motor 16 for the driving of the hollow shaft 14 has a turbine runner 100 with vanes 102 which are acted on by compressed air which comes from radial nozzles 104.

The blow device 18 has a conduit 106 for feeding compressed air, which conduit terminates in an annular chamber 108 which is provided on its end side with a plurality of paraxial nozzles 110, distributed uniformly on the periphery of the stop ring 44, the nozzles discharging into the opening opposite the ring 32 of the atomizer bell 12. The compressed air emerging there serves as deflection air in combination with an electrostatic device to reshape the radial jet produced upon the atomization of the color into a round or annular jet with axial main component.

The color feed device 20 has been shown in greatly simplified fashion by limiting it to one color. The device could be a multi-color atomizer. In such case a suction device is required which, upon the change in color, draws all color out of the color feed channel 56 which terminates at the valve 24 before the next color is sprayed.

The unit 22 is double-acting. Its piston rod is firmly connected with the valve actuating needle 54.

The manner of operation of the device described can be readily noted from its structure and the functions of its individual parts.

I claim:

1. A device for the atomizing of liquid color, particularly a lacquer sprayer, having an atomizer bell which is rotatable around a central axial opening and is provided above its rear base with a deflection part of rotational symmetry, the rear side of the center of which is opposite the opening while its radially outer edge is adjacent an overflow surface, the intermediate space between the deflection part and the base being connected in liquid-conducting manner with a free bell space above the overflow surface; and having a nozzle seated on the free end of a coaxial color feed tube, the nozzle extending into the intermediate space and discharging opposite the center of the deflection part, wherein the deflection part has in its center a cannulae labyrinth comprising a coaxial inlet lying opposite an opening of the nozzle and a coaxial outlet onto the front side of the deflection part; and the front side of the deflection part forms an annular coaxial overflow surface for overflow by a partial stream of the color which at an edge of this surface discharges into a main stream of color flowing on an end-side overflow surface of the bell.

2. The device according to claim 1, wherein the radially outer edge of the overflow surface of the deflection part and the radially inner edge of the overflow surface of the bell are flush.

3. The device according to claim 1 or 2, the atomizer bell of which is provided with an attachment part developed in one piece on the radially outer edge of the deflection part, for attachment of the deflection part to the radially inner circumference of the bell, substantially radial small channels extending from the intermediate space being formed at a transition from the deflection part to the attachment part, wherein at the transition from the deflection part to the attachment part an annular hollow space is formed into which channels discharge and which debouches into the free bell space via an annular slot between the bell and the deflection part at a place of encounter of adjacent edges of the overflow surfaces of the bell and of the deflection part.

4. The device according to claim 3, as said hollow space an annular groove closed by the bell is formed in the attachment part.

5. The device according to claim 1, the deflection part being essentially a circular disk with a central hub projecting towards the nozzle, wherein the hub contains said cannulae labyrinth.

6. The device according to claim 1, wherein the deflection part is formed on the front side thereof with a stepped substantially cylindrical depression with an inner shoulder, an insert ring rests on said shoulder, said insert ring has a central bore which is rounded in front forming the coaxial outlet of the cannulae labyrinth and terminates at a front of the insert ring flush with the overflow surface of the deflection part.

7. The device according to claim 6, further comprising a central hub of said deflection part contains said cannulae labyrinth, said inlet of said cannulae labyrinth in the hub is formed as a coaxial bore which is connected via a plurality of uniformly distributed tap cannulae of said cannulae labyrinth with an annular space at the base of the cylindrical depression behind the insert ring.

8. The device according to claim 1, wherein said cannulae labyrinth including said inlet and said outlet is so dimensioned that the partial stream of the color can be adjusted to one-fifth to one-third of the total stream through the nozzle.

9. The device according to claim 1, wherein said cannulae labyrinth further comprises means for axially forwardly diverging liquid color emerging from said coaxial inlet and for radially inwardly converging diverged liquid color emerging into said coaxial outlet.

* * * * *